US008936008B2

(12) United States Patent
Powell et al.

(10) Patent No.: US 8,936,008 B2
(45) Date of Patent: Jan. 20, 2015

(54) FLEXIBLE FUEL MODULE PROTECTED UMBRELLA VALVE

(75) Inventors: Patrick Powell, Farmington Hills, MI (US); Hajime Danjo, West Bloomfield, MI (US)

(73) Assignees: DENSO International America, Inc., Southfield, MI (US); DENSO Corporation, Kariya-shi, Aichi-ken ( * ) Notice: Subject to any disclaimer, the term of this patent is extended or adjusted under 35 U.S.C. 154(b) by 900 days.

(21) Appl. No.: 13/100,671

(22) Filed: May 4, 2011

(65) Prior Publication Data

US 2012/0247429 A1 Oct. 4, 2012

Related U.S. Application Data

(60) Provisional application No. 61/470,201, filed on Mar. 31, 2011.

(51) Int. Cl.
*F02M 37/10* (2006.01)
*F02M 37/22* (2006.01)

(52) U.S. Cl.
CPC ..... *F02M 37/103* (2013.01); *F02M 37/106* (2013.01); *F02M 2037/228* (2013.01)
USPC ..... 123/495; 123/497; 123/509

(58) Field of Classification Search
CPC ..... F02M 37/08; F02M 37/10; F02M 37/103; F02M 37/106; F02M 37/22; F02M 37/0023; F02M 37/0076; F02M 37/0082; B60K 15/06; B60K 15/077; B60K 2015/03236; B60K 2015/03256; B60K 2015/03269; B60K 2015/03296
USPC ..... 123/495, 497, 510, 511, 512, 514, 513, 123/198 C
See application file for complete search history.

(56) References Cited

U.S. PATENT DOCUMENTS

| | | | | |
|---|---|---|---|---|
| 5,642,719 | A * | 7/1997 | Brown | 123/509 |
| 5,647,329 | A * | 7/1997 | Bucci et al. | 123/509 |
| 6,505,644 | B2 | 1/2003 | Coha et al. | |
| 6,612,458 | B2 | 9/2003 | Balzer et al. | |
| 6,638,423 | B2 * | 10/2003 | Dockery | 210/132 |
| 6,640,789 | B2 * | 11/2003 | Gabauer et al. | 123/509 |
| 6,805,538 | B2 * | 10/2004 | Djordjevic | 417/201 |
| 6,837,222 | B2 | 1/2005 | Okazono et al. | |
| 6,923,164 | B1 * | 8/2005 | Mitsudou et al. | 123/509 |
| 6,981,490 | B2 | 1/2006 | Nagata et al. | |
| 7,168,416 | B2 | 1/2007 | Powell et al. | |
| 7,216,633 | B2 | 5/2007 | Attwood et al. | |
| 7,284,540 | B2 * | 10/2007 | Attwood et al. | 123/509 |
| 7,546,833 | B2 | 6/2009 | Tomomatsu et al. | |
| 7,628,143 | B2 * | 12/2009 | Yamada et al. | 123/509 |
| 2002/0152996 | A1 * | 10/2002 | Gabauer et al. | 123/509 |
| 2003/0042185 | A1 * | 3/2003 | Dockery | 210/132 |

(Continued)

*Primary Examiner* — Hai Huynh
*Assistant Examiner* — Raza Najmuddin
(74) *Attorney, Agent, or Firm* — Harness, Dickey & Pierce, P.L.C.

(57) ABSTRACT

A fuel pump module for a vehicle includes a reservoir having a longitudinal axis. An aperture is arranged within a bottom surface of the reservoir. The aperture has a plurality of vanes extending towards a central ring. An umbrella valve having an elongated stem is movably secured within the central ring of the aperture. The elongated stem is movable between a first position completely overlaying the aperture to a second position at a distance from the aperture. A suction filter is located within the reservoir at the bottom surface thereof. The suction filter has an undersurface sized for receipt of the umbrella valve in both the first and second positions.

20 Claims, 4 Drawing Sheets

(56) References Cited

U.S. PATENT DOCUMENTS

| | | | | |
|---|---|---|---|---|
| 2005/0087178 | A1* | 4/2005 | Milton | 123/509 |
| 2005/0155583 | A1* | 7/2005 | Mitsudou et al. | 123/509 |
| 2007/0125431 | A1* | 6/2007 | Nederegger et al. | 137/574 |
| 2007/0215121 | A1* | 9/2007 | Attwood et al. | 123/509 |
| 2008/0173282 | A1* | 7/2008 | Briggs et al. | 123/506 |
| 2008/0184970 | A1* | 8/2008 | Igarashi et al. | 123/509 |
| 2009/0025690 | A1* | 1/2009 | Yamada et al. | 123/509 |
| 2009/0095264 | A1* | 4/2009 | Kawajiri et al. | 123/506 |

* cited by examiner

FLEXIBLE FUEL MODULE PROTECTED UMBRELLA VALVE

CROSS-REFERENCE TO RELATED APPLICATIONS

This application claims the benefit of U.S. Provisional Application No. 61/470,201, filed on Mar. 31, 2011. The disclosure of the above application is incorporated herein by reference in its entirety.

FIELD

The present disclosure relates to fuel pump modules, and more particularly, to a protected umbrella valve for a fuel pump module.

BACKGROUND

The statements in this section merely provide background information related to the present disclosure and may not constitute prior art. Many engines, including automotive vehicle internal combustion engines, require a steady flow of fuel for operation. A fuel pump module submerged within a vehicle's fuel tank may be used to steadily pump fuel from the tank to the engine and/or fuel injection system to achieve this goal.

A typical fuel pump module has an outer shell containing a fuel pump, a suction filter, and a valve for receiving fuel from the fuel tank. The fuel pump may be centrally located within the outer shell and may have an opening for receiving fuel. The suction filter may be located in the vicinity of the opening of the fuel pump for preventing large particles in the fuel from entering fuel pump. Furthermore, the valve may be located at a lower surface of the shell and may be offset from the suction filter to allow a steady flow of fuel into the shell. The valve may be a static valve or may be a one-way valve that opens under the assistance of a vacuum or positive pressure. Accordingly, fuel is drawn into the shell through the valve and passes through the suction filter before being drawn into the fuel pump.

While excess particles are prevented from entering the fuel pump, they are not prevented from entering the reservoir of the fuel pump module. These particles may disadvantageously settle into the bottom of the reservoir and may clog the valve, thereby preventing fuel from freely entering the fuel pump module or may cause the valve to remain in an open position allowing fuel to drain from the reservoir. Furthermore, the eccentric location of the valve requires that each fuel pump module have a unique design for reaching optimal efficiency.

What is needed then is a valve arrangement that does not suffer from the above disadvantages. This, in turn, will provide a device that has a universal configuration while providing a steady flow of fuel.

SUMMARY

This section provides a general summary of the disclosure, and is not a comprehensive disclosure of its full scope or all of its features.

A fuel pump module for a vehicle includes a reservoir having a longitudinal axis. An aperture is arranged within a bottom surface of the reservoir. The aperture has a plurality of vanes extending towards a central ring. An umbrella valve having an elongated stem is movably secured within the central ring of the aperture. The elongated stem is movable between a first position completely overlaying the aperture to a second position at a distance from the aperture. A suction filter is located within the reservoir at the bottom surface thereof. The suction filter has an undersurface sized for receipt of the umbrella valve in both the first and second positions.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 1:
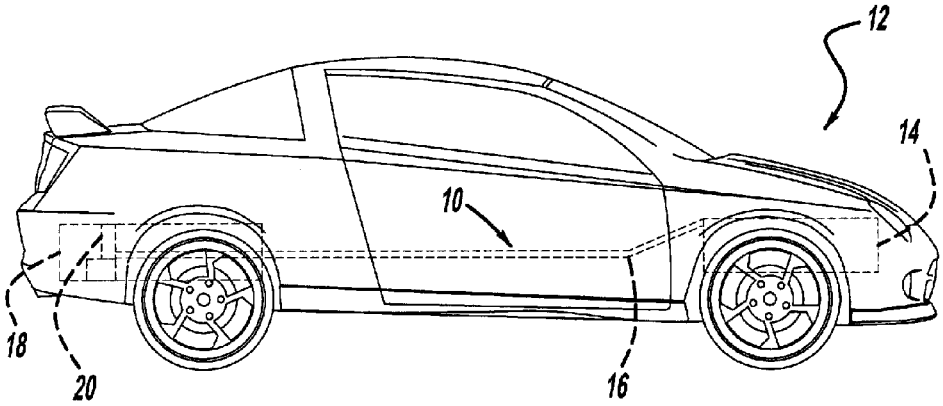
FIG. 1 is a side view of a vehicle depicting a location of a fuel supply system.

The following description is merely exemplary in nature and is not intended to limit the present disclosure, application, or uses. Throughout the drawings, corresponding reference numerals indicate like or corresponding parts and features. Turning now to FIGS. 1-8, features and details of the present teachings will be presented.

Figure 2:
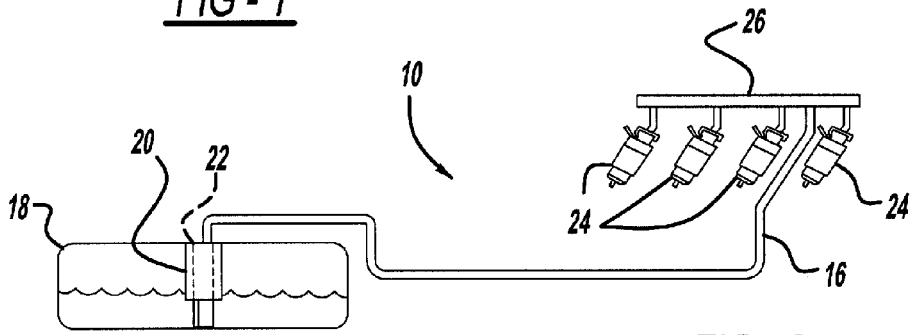
FIG. 2 is a side view of the fuel supply system depicting a fuel pump module within a fuel tank.

FIGS. 1 and 2 depict a fuel supply system 10 for a vehicle 12, such as an automobile. The vehicle 12 includes an engine 14, a fuel supply line 16, a fuel tank 18, and a fuel pump module 20. The fuel pump module 20 mounts within the fuel tank 18 and is normally submerged in or surrounded by varying amounts of liquid fuel within the fuel tank 18 when the fuel tank 18 possesses liquid fuel. At least one fuel pump 22 within the fuel pump module 20 pumps fuel to the engine 14 through the fuel supply line 16.

The fuel supply system 10 includes a plurality of fuel injectors 24 for supplying fuel to the engine 14. In a returnless fuel system, the fuel supply line 16 carries fuel from the fuel pump module 20 to a fuel injector rail 26 (also referred to as a "common rail"). After reaching the injector rail 26, fuel passes into the individual fuel injectors 24 before being sprayed or injected into individual combustion chambers of the engine 14. As should be understood, in the returnless fuel system, the fuel supply system 10 has no fuel return line from the injector rail 26 back to the fuel tank 18. It is also contemplated, however, to use the present design in a return-type fuel system having a fuel return line (not shown).

Figure 3:
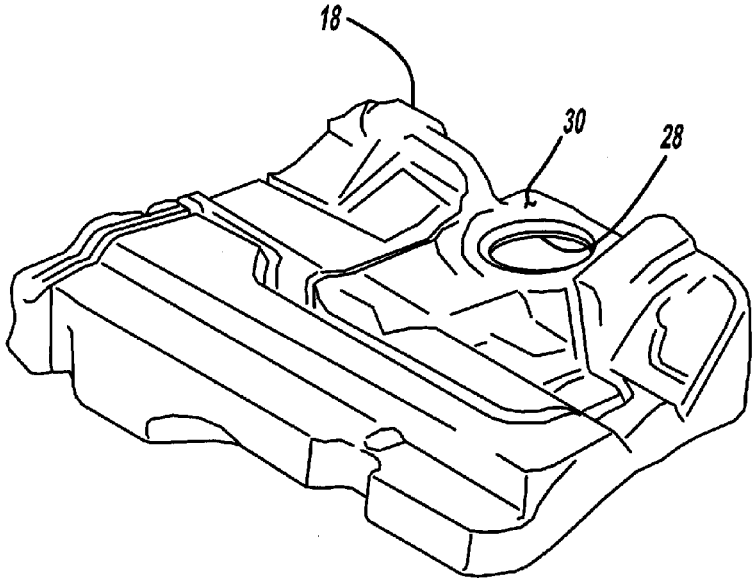
FIG. 3 is a perspective view of the fuel tank depicting an aperture for installation of the fuel pump module.
Figure 4:
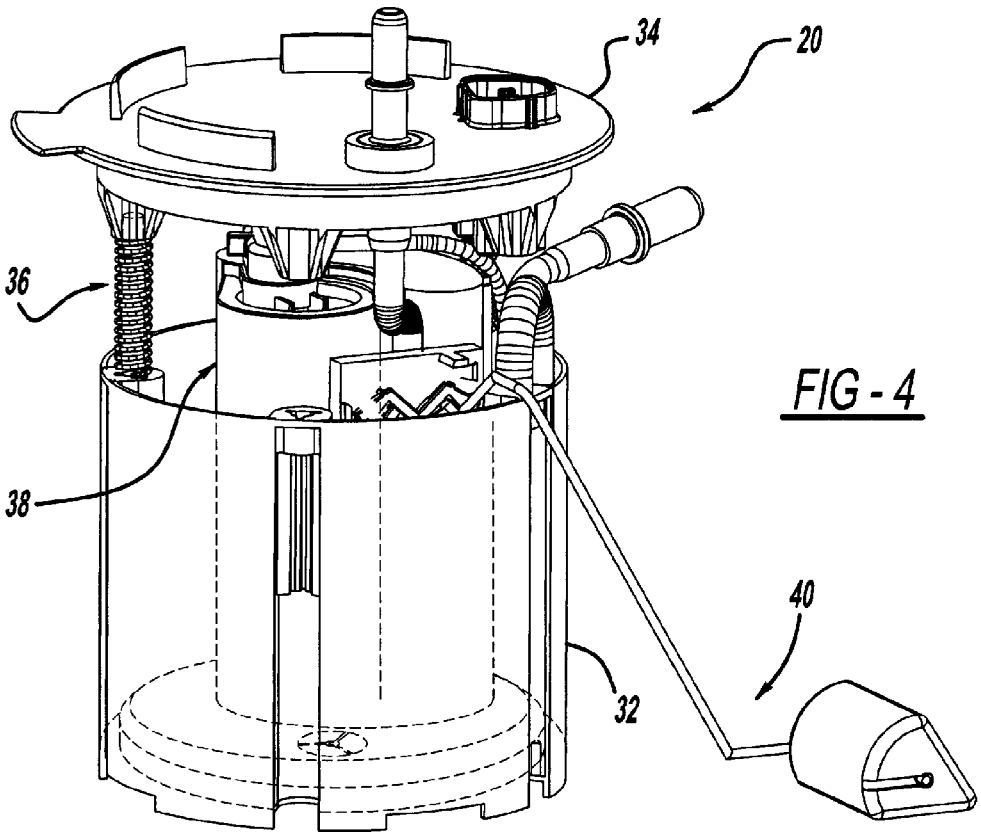
FIG. 4 is a simplified perspective view of the fuel pump module depicting certain components of the fuel pump module.
Figure 5:
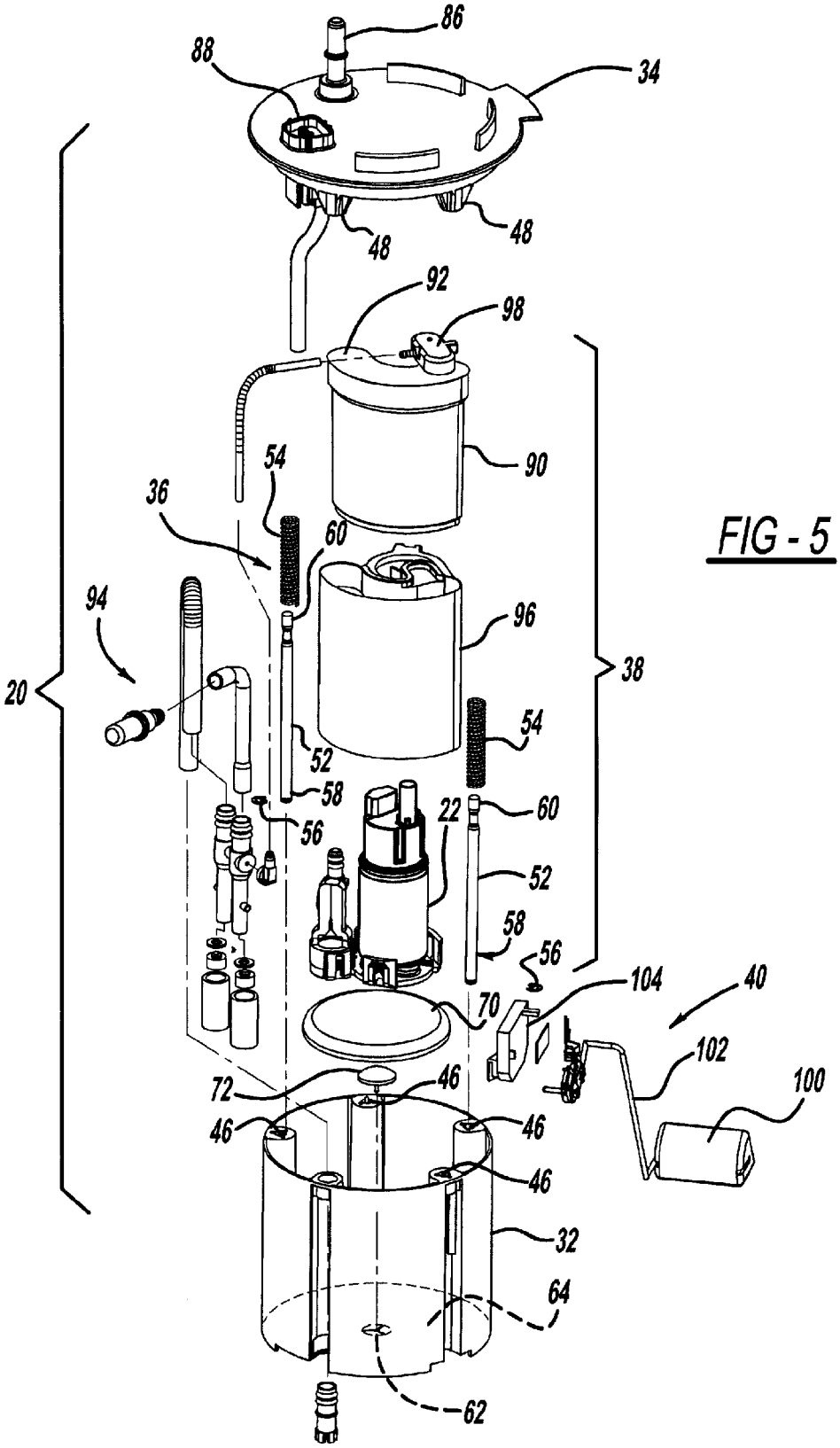
FIG. 5 is an exploded view of the simplified componentry of the fuel pump module of FIG. 4.

With reference now to FIGS. 3 through 5, the vehicle fuel tank 18 includes a mounting location 28 within a top or upper surface 30 for receipt of the fuel pump module 20. A generally vertical cylindrical reservoir 32 of the fuel pump module 20 may be lowered into the fuel tank 18 at the mounting location 28 for installation therewith. More specifically, a fuel pump module flange 34 rests on the upper surface 30 when the fuel pump module 20 is in an installed position. The fuel tank 18 may include features for retaining the fuel pump module flange 34, such as a tab (not shown) to which the flange 34 may be secured.

The fuel pump module 20 may include the cylindrical reservoir 32, the flange 34, a retention mechanism 36, a pump and filter assembly 38, and a float gauge 40. Further discussion of the arrangement and function of the fuel pump module 20 is described in detail in commonly assigned applications 61/470,179 (filed on Mar. 31, 2011); 61/470,183 (filed on Mar. 31, 2011); 61/470,192 (filed on Mar. 31, 2011); 61/470,199 (filed on Mar. 31, 2011). Each of these applications is incorporated by reference herein in its entirety.

Both the reservoir 32 and the flange 34 may incorporate integrally formed rod sockets 46, 48, respectively, for receipt of the retention mechanism 36. Accordingly, the reservoir 32 may be firmly biased against the bottom interior 50 of the fuel tank 18 (FIG. 7) with the retention mechanism 36. It should be understood that while the reservoir 32 is described as being vertically oriented herein, the reservoir 32 may alternately be oriented generally horizontally (not shown). The horizontal arrangement requires less depth in the fuel tank 18 for accommodating the reservoir 32, while the vertically oriented reservoir 32 requires less horizontal space for installation. That is, the fuel tank 18 having the generally vertical reservoir 32 may have a smaller overall diameter than its horizontal counterpart for the same application, albeit a greater height.

The retention mechanism 36 may include at least one rod 52, at least one spring 54, and at least one stopper 56. As each rod/spring pair behaves in substantially the same manner, only a single rod/spring combination will be used to exemplify the details of the disclosure. A first end 58 of the rod 52 may be secured to the reservoir 32, such as by press-fitting or crimping the rod 52 at the rod socket 46. Alternatively, the first end 58 of the rod 52 may be passed through the rod socket 46 and secured with the stopper 56 (e.g., a washer). A second end 60 of the rod 52 may be secured to the flange 34, such as with a press-fit or snap fit into the rod socket 48. The spring 54 may encompass the rod 52 and may be compressed between the reservoir 32 and the flange 34 for providing a biasing force therebetween. The stopper 56 may prevent the first end 58 from backing out of the rod socket 46 due to the compression force of the spring 54. The reservoir 32 may be repositioned relative to the flange 34 by moving the rod 52 into the various rod sockets 46. Accordingly, the location of the reservoir 32 with respect to the mounting location 28 may be easily modified for alternate applications. For example, the reservoir 32 may be directly under the flange 34 or may be radially offset from the flange 34.

Figure 6:
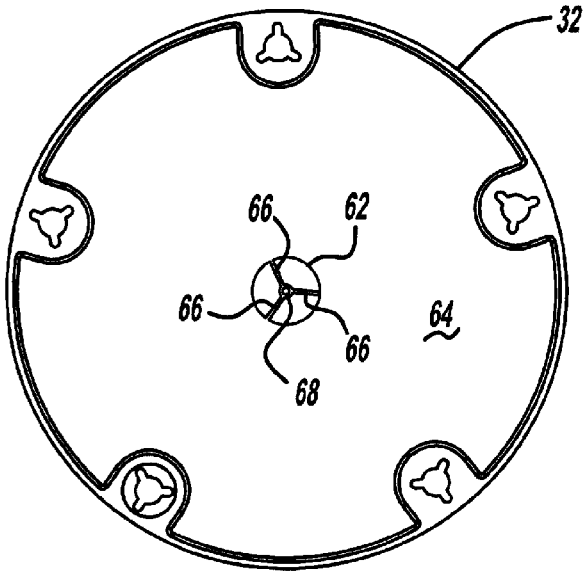
FIG. 6 is a top view of a reservoir of the fuel pump module of FIG. 4.

With reference to FIGS. 5 and 6, the reservoir 32 may further include an aperture 62 integrally formed into a bottom surface 64 thereof. The aperture 62 may be located coaxially and concentrically within the bottom surface 64 of the reservoir 32 and may have a plurality of vanes 66 extending towards a central ring 68. The aperture 62 may be sized so as to be completely enclosed by a suction filter 70 and an umbrella valve 72, as will be described in more detail below with respect to FIGS. 7 and 8. While the aperture 62 is shown as being trifurcated, it should be understood that the aperture 62 may have any number of vanes 66 for allowing fuel to flow therethrough. Furthermore, the number of vanes 66 is selected to provide a size to openings of the aperture for limiting the ingress of large particles in the fuel into the reservoir. Accordingly, the location of the aperture 62 in the bottom surface 64 of the reservoir 32 and the arrangement of the vanes 66 allows fuel to enter the reservoir 32, but prevents the entrance of large particles found in the fuel.

Figure 7:
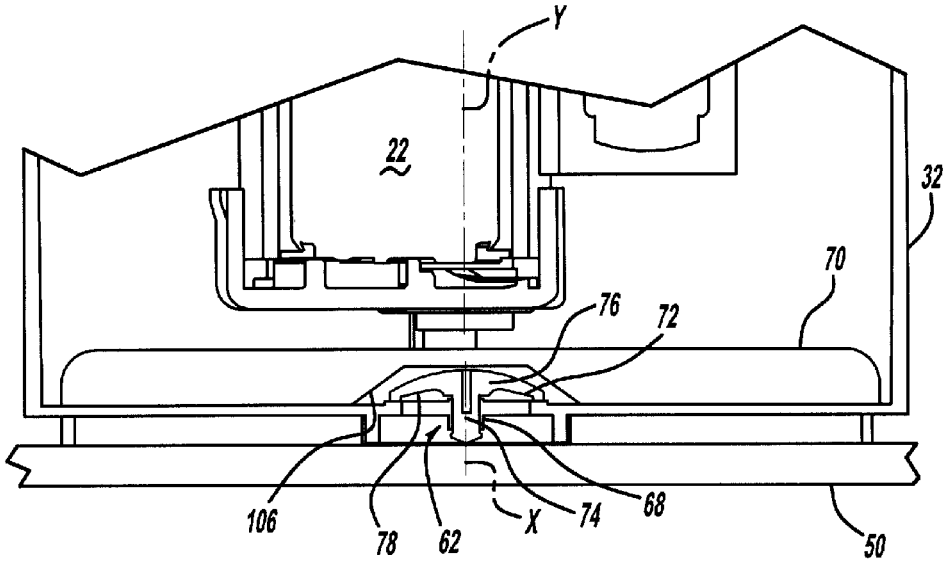
FIG. 7 is a sectional view of a portion of the fuel pump module of FIG. 4 depicting an umbrella valve in a closed position.
Figure 8:
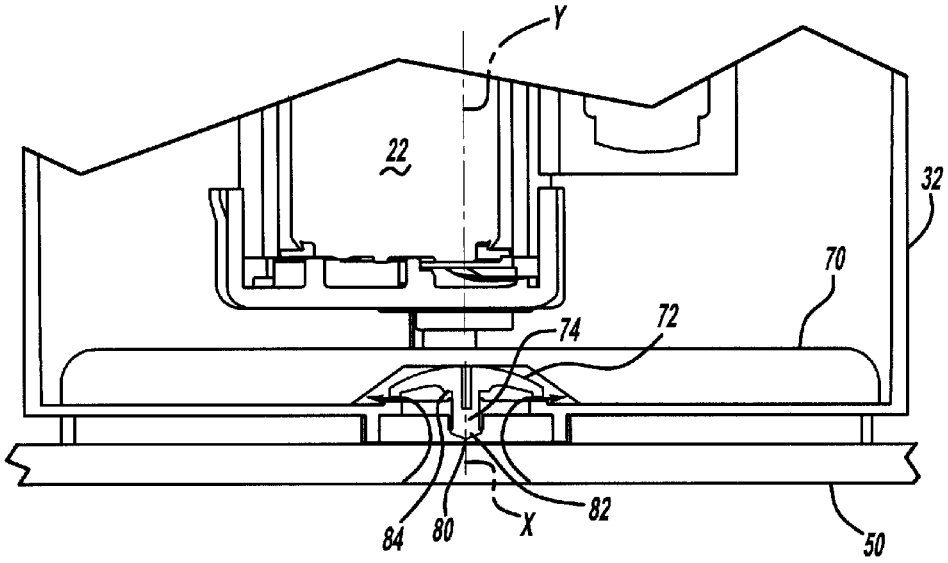
FIG. 8 is a sectional view of a portion of the fuel pump module of FIG. 4 depicting the umbrella valve in an opened position.

With reference now to FIGS. 7 and 8, the umbrella valve 72 may be received within the central ring 68 of the aperture 62. The umbrella valve 72 may include an elongated stem 74, a convex or mushroom cap 76, and a concave undersurface 78. The umbrella valve 72 may be formed from a flexible polymeric material (e.g., rubber).

The elongated stem 74 of the umbrella valve 72 may have a longitudinal axis, X, coaxially aligned with the longitudinal axis, Y, of the reservoir 32. The elongated stem 74 of the umbrella valve 72 may be arranged to fit within the central ring 68 of the aperture 62, but may have a height that is slightly longer than the height of the central ring 68. In this way, the umbrella valve 72 may move freely from a first, closed position (FIG. 7) to a second, opened position (FIG. 8) along the longitudinal axis, X. The longitudinal movement of the umbrella valve 72 may be limited by an enlarged portion 80 at a terminal end 82 of the elongated stem 74 and by the concave undersurface 78 at the initial end 84 of the elongated stem 74.

The mushroom cap 76 may be situated below the suction filter 70 and may be spaced therefrom by a distance corresponding to the movement between first position and the second position of the elongated stem 74. Accordingly, the suction filter 70 does not interfere with movement of the umbrella valve 72. The mushroom cap 76 may be convexly shaped so as to minimize the profile of the umbrella valve 72 in order to reduce the amount of pressure necessary to open the valve 72. Furthermore, the concave undersurface 78 of the umbrella valve 72 minimizes contact friction between the bottom surface 64 of the reservoir 32. In this way, the concave undersurface 78 provides increased area for fuel in the fuel tank 18 to apply pressure to open the umbrella valve 72.

With reference again to FIG. 5, the flange 34 may include the rod sockets 48, a fuel supply line port 86, and an electrical connector port 88. The fuel supply line port 86 may be any attachment mechanism for interconnecting the supply of fuel from the fuel pump module 20 to the fuel supply line 16. As the fuel pump 22 may be an electric pump, the electrical connector port 88 may provide the necessary connection between the electronic control unit (ECU) and the fuel pump 22. Furthermore, the fuel supply line port 86 and the electrical connector port 88 may be located at any position on the flange 34 in order to meet packaging expectations.

The pump and filter assembly 38 may be arranged within the reservoir 32 and may include the fuel pump 22, a main filter 90, a check valve 92, a jet pump assembly 94, and a housing 96. The fuel pump 22 may draw fuel from the reservoir 32 and through the main filter 90 for removing any contaminants therewith. The fuel pump 22 may then expel the fuel through the check valve 92 located at or near a top surface 98 of the filter 90. The check valve 92 may be a one-way valve that opens in response to positive pressure from within the fuel pump 22 to permit fuel to flow from the fuel pump 22 into the fuel supply line 16 via the fuel supply line port 86.

The float gauge 40 may include a float 100, an arm 102, and a sender gauge 104. The float 100 may be a polymeric member sized and weighted so as to float along the surface of the fuel in the fuel tank 18. Accordingly, the float 100 raises and lowers in response to fuel levels in the fuel tank 18. The float 100 may be interconnected with the sender gauge 104 by the arm 102. The sender gauge 104 may detect a position of the float 100 based on movement of the arm 102, and may relay this position to the ECU. In this way, the operator of the vehicle 12 may be apprised of fuel level within the fuel tank 18. Furthermore, operation of the fuel pump module 20 may be controlled based upon levels of fuel within the fuel tank 18.

Priming of the fuel pump module 20 will now be described with reference to FIGS. 5 through 8. Fuel in the fuel tank 18 may provide a positive pressure at the aperture 62 in the bottom surface 64 of the reservoir 32. This positive pressure may cause the umbrella valve 72 to move from the first, closed position (FIG. 7) to the second, open position (FIG. 8). As the umbrella valve 72 moves to the open position, an influx of fuel is introduced into the space between the mushroom cap 76 of the umbrella valve 72 and an undersurface 106 of the suction filter 70. Notably, however, the vanes 66 prevent any large particles in the fuel tank 18 from entering the aperture 62.

The fuel must pass through the suction filter 70 before entering the reservoir 32. In this way, particles large enough to pass through the vanes 66 are still prevented from entering the reservoir 32. The fuel in the reservoir 32 is then drawn into the fuel pump 22 and forced through the main filter 90 for removing additional contaminants. Next, the fuel pump 22 expels the pressurized and filtered fuel through the check valve 92 for receipt by the fuel supply line 16 via the fuel supply line port 86.

Notably, the umbrella valve 72 may return from the second, open position (FIG. 8) to the first, closed position (FIG. 7) when the amount of fuel falls below a specified level. This occurs because the pressure necessary for retaining the valve 72 in the open position has been removed.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A fuel pump module for a vehicle, comprising:

a reservoir having a longitudinal axis;

an aperture arranged within a bottom surface of the reservoir and having a plurality of vanes extending towards a central ring;

an umbrella valve having an elongated stem and a cap movably secured within the central ring of the aperture, the elongated stem and the cap movable between a first position where the cap completely overlays the aperture to a second position where the cap is at a distance from the aperture; and a suction filter within the reservoir at the bottom surface thereof, the suction filter having an undersurface including a concavity, the concavity sized for receipt of the cap of the umbrella valve in both the first and second positions, wherein the umbrella valve is spaced from the suction filter by a distance corresponding to the movement between the first position and the second position such that the suction filter does not interfere with the movement of the umbrella valve; and the entire undersurface of the suction filter, other than the concavity, being in direct contact with the bottom surface of the reservoir.

2. The fuel pump module of claim 1, wherein the plurality of vanes trifurcate the aperture.

3. The fuel pump module of claim 1, wherein a fuel provides a pressure for moving the umbrella valve from the first position to the second position.

4. The fuel pump module of claim 3, wherein the number of vanes are selected to provide a size to the openings of the aperture for limiting the ingress of large particles in the fuel into the reservoir.

5. The fuel pump module of claim 1, wherein the umbrella valve is formed from a polymeric material.

6. The fuel pump module of claim 5, wherein the polymeric material is flexible.

7. The fuel pump module of claim 1, wherein the umbrella valve is limited in range of movement by an enlarged portion at a terminal end and a concave undersurface at an initial end thereof.

8. The fuel pump module of claim 7, wherein the umbrella valve is movable between the first and second positions when a pressure is applied to the concave undersurface.

9. The fuel pump module of claim 8, wherein fuel enters the reservoir when the umbrella valve is in the second position.

10. A fuel pump module, comprising:

a reservoir having an aperture arranged within a bottom surface thereof;

a plurality of vanes trifurcating the aperture, the vanes extending towards a central ring aligned with a longitudinal axis of the reservoir;

an umbrella valve having a cap arranged within the central ring of the aperture, the umbrella valve movable between a first position where the cap covers the aperture to a second position where the cap is spaced from the aperture; and a suction filter having an undersurface including a concavity, the concavity encompassing the cap of the umbrella valve, wherein the umbrella valve allows an influx of fuel through the aperture when in the second position, the influx of fuel passing through the suction filter before entering the reservoir, wherein the umbrella valve is spaced from the suction filter by a distance corresponding to the movement between the first position and the second position such that the suction filter does not interfere with the movement of the umbrella valve; and the entire undersurface of the suction filter, other than the concavity, being in direct contact with the bottom surface of the reservoir.

11. The fuel pump module of claim 10, wherein the umbrella valve includes an elongated stem movably secured within the central ring of the aperture, the elongated stem having an enlarged portion at a terminal end and a concave undersurface at an initial end thereof.

12. The fuel pump module of claim 11, wherein the umbrella valve is movable between the first and second positions when a pressure is applied to the concave undersurface.

13. The fuel pump module of claim 10, wherein the suction filter is secured to the bottom surface of the reservoir.

14. The fuel pump module of claim 10, wherein the plurality of vanes provide a size to openings of the aperture for limiting the ingress of large particles in the fuel into the reservoir.

15. The fuel pump module of claim 10, wherein the umbrella valve is formed from a polymeric material.

16. The fuel pump module of claim 15, wherein the polymeric material is flexible.

17. A method for priming a fuel pump module, comprising:

providing a fuel having a positive pressure at a centrally located aperture in a bottom surface of a reservoir of the fuel pump module;

providing an umbrella valve having a cap;

providing a suction filter having an undersurface including a concavity, the concavity encompassing the umbrella valve;

locating the suction filter such that the cap of the umbrella valve is disposed within the concavity of the suction filter and the entire undersurface of the suction filter other than the concavity is in direct contact with the bottom surface of the reservoir;

moving the umbrella valve from a first, closed position to a second, open position with the fuel;

passing the fuel through a plurality of vanes in the aperture;

passing the fuel around the umbrella valve in the open position; and passing the fuel through the suction filter before entering a fuel pump, wherein the umbrella valve is spaced from the suction filter by a distance corresponding to the movement between the first position and the second position such that the suction filter does not interfere with the movement of the umbrella valve.

18. The method of claim 17, further comprising:

bringing an enlarged portion of the umbrella valve into engagement with a central ring of the centrally located aperture to prevent movement of the umbrella valve past the second position.

19. The method of claim 17, further comprising:

blocking large particles from entering the reservoir with the plurality of vanes, as the fuel passes through the vanes in the aperture.

20. The method of claim 17, further comprising:

returning the umbrella valve to the closed position when the fuel in a fuel tank falls below a predetermined level.

* * * * *